US007325509B2

(12) United States Patent
Gordon et al.

(10) Patent No.: US 7,325,509 B2
(45) Date of Patent: Feb. 5, 2008

(54) RETRACTABLE MOORING LINE DEVICE

(75) Inventors: Leslea C. Gordon, 2269 Lakeshore Blvd. West, Suite 2708, Toronto, Ontario M8V 3X6 (CA); Darrel C. Knight, 2269 Lakeshore Blvd. West, Suite 2708, Toronto, Ontario M8V 3X6 (CA); Farhat Hanna, Leamington (CA)

(73) Assignees: Leslea C. Gordon, Toronto, Ontario (CA); Darrel C. Knight, Toronto, Ontario (CA)

( * ) Notice: Subject to any disclaimer, the term of this patent is extended or adjusted under 35 U.S.C. 154(b) by 43 days.

(21) Appl. No.: 10/527,170

(22) PCT Filed: Mar. 18, 2003

(86) PCT No.: PCT/CA03/00362

§ 371 (c)(1),
(2), (4) Date: Oct. 28, 2005

(87) PCT Pub. No.: WO2004/024553

PCT Pub. Date: Mar. 25, 2004

(65) Prior Publication Data

US 2006/0150883 A1 Jul. 13, 2006

(30) Foreign Application Priority Data

Sep. 11, 2002 (CA) ..... 2397926

(51) Int. Cl.
*B63B 21/00* (2006.01)

(52) U.S. Cl. ..... 114/230.23; 114/230.1; 114/230.2; 114/230.24

(58) Field of Classification Search ..... 114/230.1, 114/230.2, 230.23, 230.24
See application file for complete search history.

(56) References Cited

U.S. PATENT DOCUMENTS 1,811,400 A 6/1931 McClellan (Continued)

FOREIGN PATENT DOCUMENTS

DE 23 28 449 A1 1/1975

(Continued)

*Primary Examiner*—Lars A. Olson
*Assistant Examiner*—Daniel V. Venne
(74) *Attorney, Agent, or Firm*—Dimock Stratton LLP; Mark B. Eisen

(57) ABSTRACT

A retractable mooring line device comprising a reel for storing and paying off a mooring line (2), having side walls (22, 24) each comprising a series of notches (60) for receiving a releasable latch (54). A latch simultaneously engages between notches in both side walls (22, 24) at a substantially right angle to provide a secure, positive locking engagement between the latch and the reel while permitting the latch (54) to be released under the application of relatively little force. In the preferred embodiment the latch may be actuated by a user's hand or foot and is biased toward the reel by a spring (70) which bears against the housing (18). The mechanism can be exposed for maintenance or repair simply by removal of the gunnel plate (16) and reinstallation of the gunnel plate does not require special loading of the latch spring.

15 Claims, 12 Drawing Sheets

U.S. PATENT DOCUMENTS

| | | | | | |
|---|---|---|---|---|---|
| 2,686,491 | A | | 8/1954 | Ohmstede | |
| 3,012,736 | A | | 12/1961 | Brust | |
| 3,261,591 | A | | 7/1966 | Campbell et al. | |
| 3,326,493 | A | | 6/1967 | Bondesen, Jr. et al. | |
| 3,851,613 | A | | 12/1974 | Armour | |
| 3,955,525 | A | | 5/1976 | Seiford, Sr. | |
| 4,476,801 | A | | 10/1984 | Foster et al. | |
| 4,697,537 | A | | 10/1987 | Smith | |
| 4,722,293 | A | | 2/1988 | Foster et al. | |
| 4,726,313 | A | | 2/1988 | Neal | |
| 4,781,636 | A | * | 11/1988 | Schurr | 441/6 |
| 4,809,635 | A | | 3/1989 | Essig | |
| 4,846,090 | A | * | 7/1989 | Palmquist | 114/230.23 |
| 4,878,452 | A | | 11/1989 | Regan et al. | |
| 5,002,003 | A | * | 3/1991 | Blue | 114/230.23 |
| 5,053,586 | A | | 10/1991 | Hansson | |
| 5,364,075 | A | | 11/1994 | Montgomery | |
| 5,522,336 | A | | 6/1996 | Fujita | |
| 5,577,843 | A | | 11/1996 | Leininger et al. | |
| 5,819,679 | A | | 10/1998 | Bonate et al. | |
| 6,095,075 | A | * | 8/2000 | Gordon et al. | 114/230.23 |
| 6,139,234 | A | | 10/2000 | Huang | |
| 2005/0202734 | A1 | * | 9/2005 | Miller | 440/83 |

FOREIGN PATENT DOCUMENTS

| | | |
|---|---|---|
| FR | 2 294 977 | 7/1976 |
| FR | 2 659 623 A1 | 9/1991 |
| GB | 2 368 056 A | 4/2002 |

* cited by examiner

RETRACTABLE MOORING LINE DEVICE

FIELD OF THE INVENTION

This invention relates to mooring lines. In particular, this invention relates to a retractable mooring line device for a boat or other watercraft.

BACKGROUND OF THE INVENTION

Mooring or docking a boat conventionally involves tying at least one mooring line between a cleat secured to the boat and a dock, pier, slip or other stationary mooring structure. This can be a difficult and trying task, particularly in rough water where the motion of the boat and slippery wet surfaces can render it difficult to properly secure the mooring line to the boat.

Moreover, the boat must be equipped with a mooring line of sufficient length to accommodate various mooring environments, although in many cases only a portion of the mooring line will be required to secure the boat. The excess mooring line can be difficult to stow neatly, and is thus subject to becoming knotted or tangled, or entangled with persons, cargo or equipment on the boat, which can pose both an inconvenience and a hazard.

Retractable mooring lines have been proposed, in which a line is wound about a payoff reel and dispensed as needed to moor the boat under the particular mooring conditions encountered at the time. An example of such a device is described and illustrated in U.S. Pat. No. 4,846,090 issued Jul. 11, 1989 to Palmquist, which is incorporated herein by reference, which teaches a spring-loaded reel biased in the take-up direction and provided with a ratchet-type lock that is selectively engaged to ratchet teeth provided along the edges of the reel guide walls, to prevent rotation in the payoff direction when the boat is moored.

However, the use of a ratchet-type lock with a spring-loaded payoff reel can cause problems due to the oscillating motion experienced by a moored boat in wavy conditions. Where the mooring structure is above the level of the securing point on the boat, as the boat is lifted upwardly by a wave the tension on the mooring line is temporarily released, which allows the reel to rotate in the take-up direction. As the crest of the wave passes, the boat begins to fall, but in the newly locked position of the reel the mooring line is too short to allow the boat to freely roll off of the wave, causing the boat to list away from the mooring structure. Similarly, where the mooring structure is below the level of the securing point on the boat, when the boat falls into a trough the tension on the mooring line is temporarily released, which allows the reel to turn in the take-up direction and locks the mooring line so that as the crest of the next wave arrives and lifts the boat the mooring line is too short to allow the boat to rise to the crest of the wave, causing the boat to list toward the mooring structure.

A retractable mooring line device which provides a positive lock against rotation of the payoff reel in both directions is described in U.S. Pat. No. 6,095,075 issued Aug. 1, 2000 to Gordon et al., which is incorporated herein by reference. This device is particularly suitable for light- and medium-duty applications. However, the latch engages only one wall of the payoff reel. A moored boat can be subjected to very high peak forces due to wave action and currents, and repetitive momentary tension on the mooring line is transferred to the payoff reel, which in turn subjects the locking mechanism to high momentary stresses. The payoff reel guide wall becomes subject to shearing or deformation and thus must be formed to a gauge sufficient to resist deformation under ordinary conditions.

It would accordingly be advantageous to provide a retractable mooring device with a payoff reel that can be locked in both the payoff and take-up directions and which provides a secure and stable lock simultaneously against both walls of the payoff reel, to effectively double the resistance to deformation of the reel under the stresses normally encountered by a mooring line, but in which the lock can be released with minimal effort.

SUMMARY OF THE INVENTION

The present invention overcomes the above disadvantages by providing a retractable mooring line device which locks the payoff reel against rotation in both the payoff and take-up directions. The locking mechanism in the device of the invention is sturdy and stable, yet easy to release.

The invention accomplishes this by providing a reel for storing and paying off the mooring line, having side walls each comprising a series of notches for receiving a releasable latch. The latch engages between notches at a substantially right angle, which provides a secure, positive locking engagement between the latch and the reel while permitting the latch to be released under the application of relatively little force.

In one preferred embodiment having a generally vertical orientation, and thus suitable for mounting internally within the gunnel or transom of a boat, the latch is actuated by a lever having a broad actuation plate which can be easily actuated by a user's hand or foot, and engages the reel radially. The latch is preferably biased to a locked position, i.e. with the latch engaging the reel, by a spring which bears against the gunnel plate, and thus the mechanism can be exposed for maintenance or repair simply by removal of the gunnel plate and the gunnel plate can then be reinstalled without requiring special loading or positioning of the latch spring.

In a further embodiment which is particularly suitable for mounting horizontally, for example within a pontoon of a pontoon or deck boat or the like, in which the latch is actuated by a button which can be actuated by a user's hand or foot. In this embodiment the latch moves axially relative to the reel and is provided with a pair of notches which align with the walls of the reel when the latch is in the release position. Preferably the latch is retained by the top plate and biased to the locked position by a spring which bears against the bottom of the housing, so in this embodiment after removing the housing the top plate can be removed and reinstalled without requiring special loading or positioning of the latch spring.

The present invention thus provides a retractable mooring line device, comprising a housing comprising side plates, a rotatable reel comprising sidewalls affixed in spaced relation to a hub, rotatably mounted to the side plates of the housing, the sidewalls each having a series of notches about its periphery, and a locking mechanism comprising a latching member pivotably mounted adjacent to the reel by a hub, comprising a latch positioned and configured to move between an unlocked position in which the latch disengages from the reel and a locked position in which the latch engages at least one of the series of notches about the periphery of each of the side walls of the reel, whereby when the latch is engaged to the notches the reel is prevented from rotation, and when the latch is disengaged from the notches the reel is capable of rotation in two directions.

The present invention further provides a retractable mooring line device, comprising a housing comprising side plates and a gunnel plate affixed to a top edge of each side plate, a rotatable reel comprising sidewalls affixed in spaced relation to a hub, rotatably mounted to the side plates of the housing, the sidewalls each having a series of notches about its periphery, and a locking mechanism comprising a latching member pivotably mounted adjacent to the reel by a hub, comprising an actuating plate exposed to an exterior of the housing and a latch disposed on opposed sides of the hub, the latch being positioned and configured to move between an unlocked position in which the latch disengages from the reel and a locked position in which the latch engages at least one of the series of notches about the periphery of each of the side walls of the reel, the latching member comprising a spring bearing against the gunnel plate and urging the latch toward the locked position, whereby when the latch is engaged to the notches the reel is prevented from rotation, and when the latch is disengaged from the notches the reel is capable of rotation in two directions.

BRIEF DESCRIPTION OF THE DRAWINGS

In drawings which illustrate by way of example only preferred embodiments of the invention.

DETAILED DESCRIPTION OF THE INVENTION

Figure 1:
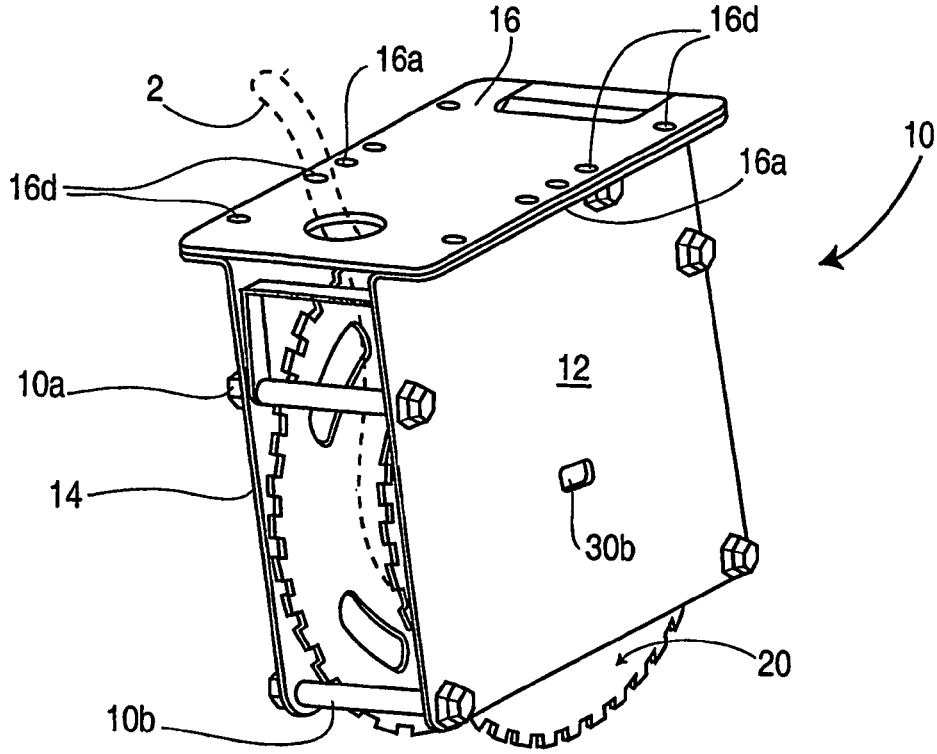
FIG. 1 is a perspective view of a first embodiment of the retractable mooring line device according to the invention, having a generally vertical orientation.
Figure 2:
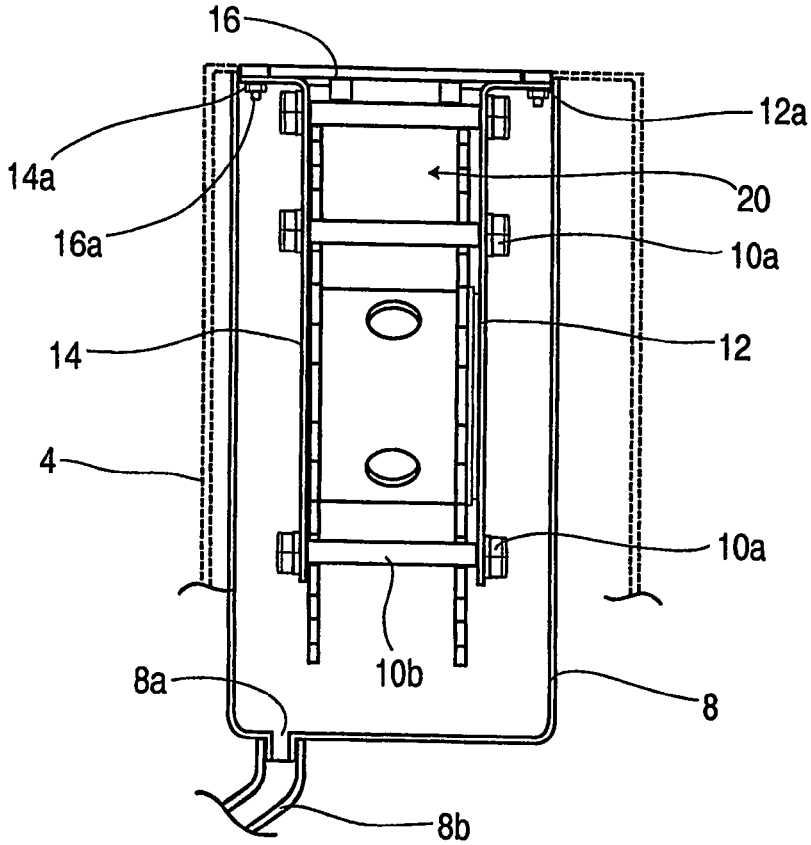
FIG. 2 is an end elevation of the device of FIG. 1.

FIGS. 1 and 2 illustrate a first embodiment of the retractable mooring line device according to the invention. The device comprises a housing 10 comprising side plates 12, 14 and a gunnel plate 16. The side plates 12, 14 are connected in spaced relation as by bolts 10*a* extending through spacer sleeves 10*b*, leaving sufficient clearance to allow free rotation of the reel 20.

The gunnel plate 16 is preferably affixed to flanges 12*a*, 14*a* of the respective side plates 12, 14, as by bolts 16*a* with countersunk heads exposed for removal in case the device requires maintenance or repair. An opening 16*c* is provided in the gunnel plate 16 for the mooring line 2, shown in phantom in FIG. 1, to pass out of the housing 10.

All components of the device are preferably composed of stainless steel, except as otherwise indicating in the following description. However, it will be appreciated that other materials may be suitable for any particular application, for example aluminium or plastic may be used for light duty applications, and the invention is not intended to be limited thereby.

The device may be housed in a plastic or fiberglass cup or casing 8, as shown in FIG. 2, which provides a drainage outlet 8*a* to allow water to drain directly out of the hull of the watercraft, for example through a flexible hose 8*b*.

Figure 4:
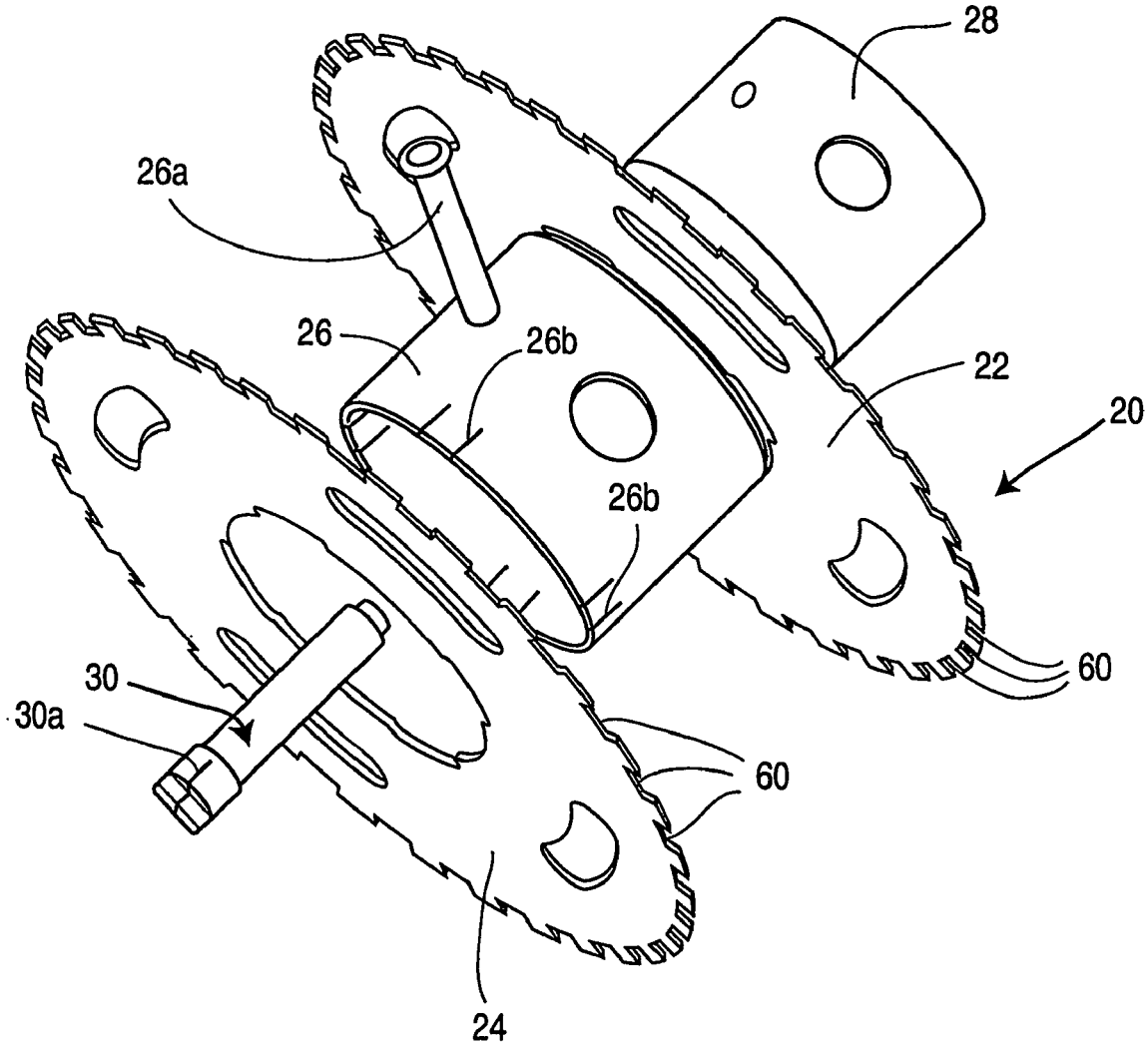
FIG. 4 is a partially exploded view of the reel and reel mounting mechanism.

The reel 20, illustrated in FIG. 4, comprises a pair of side walls 22, 24 connected by (for example welded to) a hub 26. The hub 26 fits snugly over a main bushing 28, which is preferably composed of a self lubricating high density plastic, which in turn mounts over an axle or pin 30 rotationally fixed relative to the side plates 12, 14 of the housing 10. The hub 26 is rotationally locked to the main bushing 28 by one or more locking pins 26*a*, and the bushing 28 remains free to rotate on pin 30.

Figure 5:
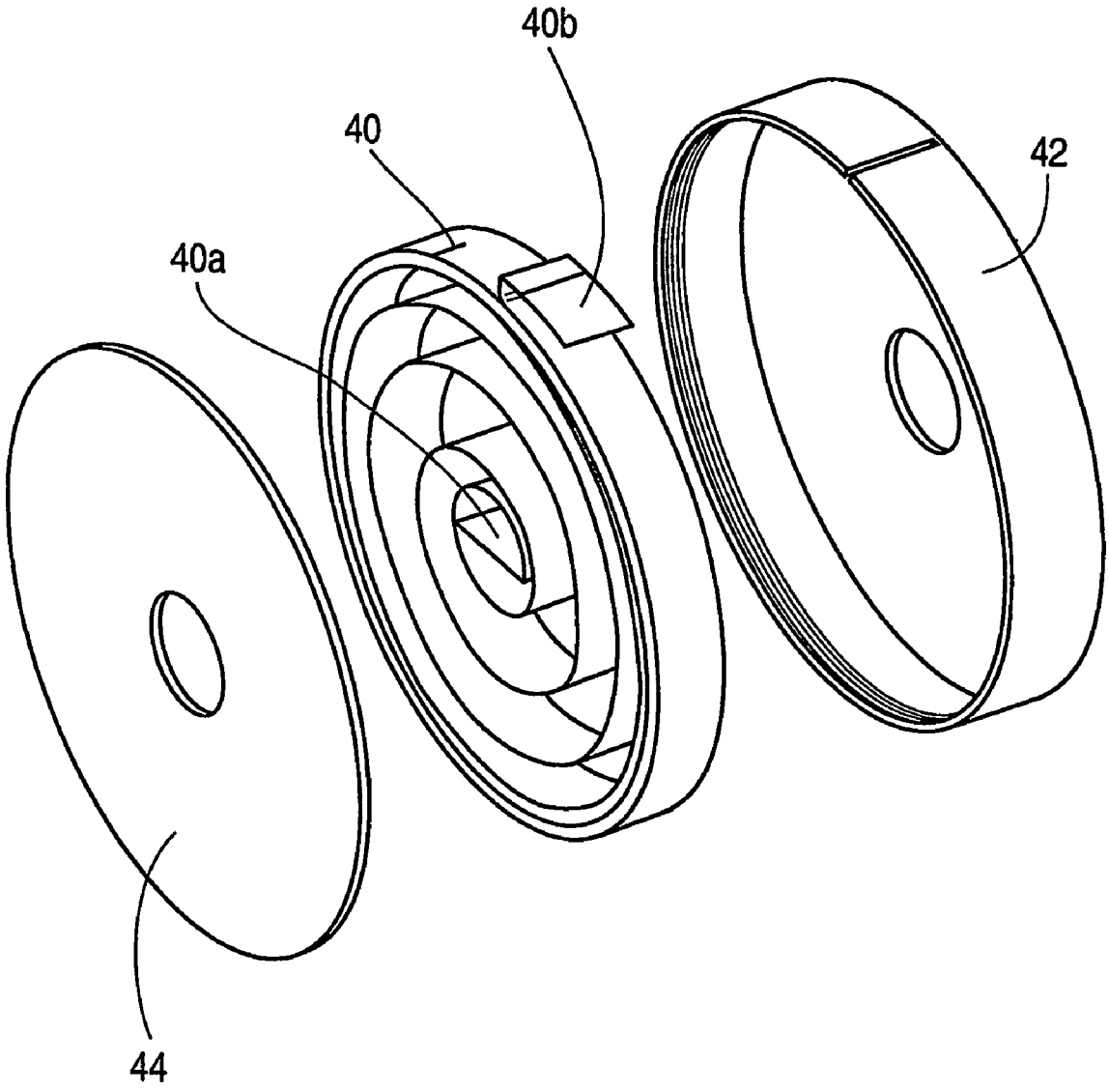
FIG. 5 is an exploded view of a preferred embodiment of a spring for loading the reel.

The reel is preferably spring loaded for automatic retraction when the locking mechanism (described below) is released. A spring 40, illustrated in FIG. 5, has a first anchoring end 40*a* for engaging a slot 30*a* or other engaging means at one end of the pin 30, and a second anchoring end 40*b* for engaging a slot 26*b* or other engaging means in the hub 26. Preferably the hub 26 is provided with a plurality of evenly spaced slots 26*b*, so that the spring can be fixed to the hub 26 in one of a number of positions without requiring rotation of the reel 20 into a specific position. Also, preferably the spring 40 is contained within a casing 41 comprising a body 42 and a lid 44, composed of the same self lubricating plastic as the bushing 28. The casing 41 serves to both contain the spring against dislodgement when the reel 20 is removed from the housing 10 for servicing and to protect the spring 40 from salt water and the elements.

Figure 6:
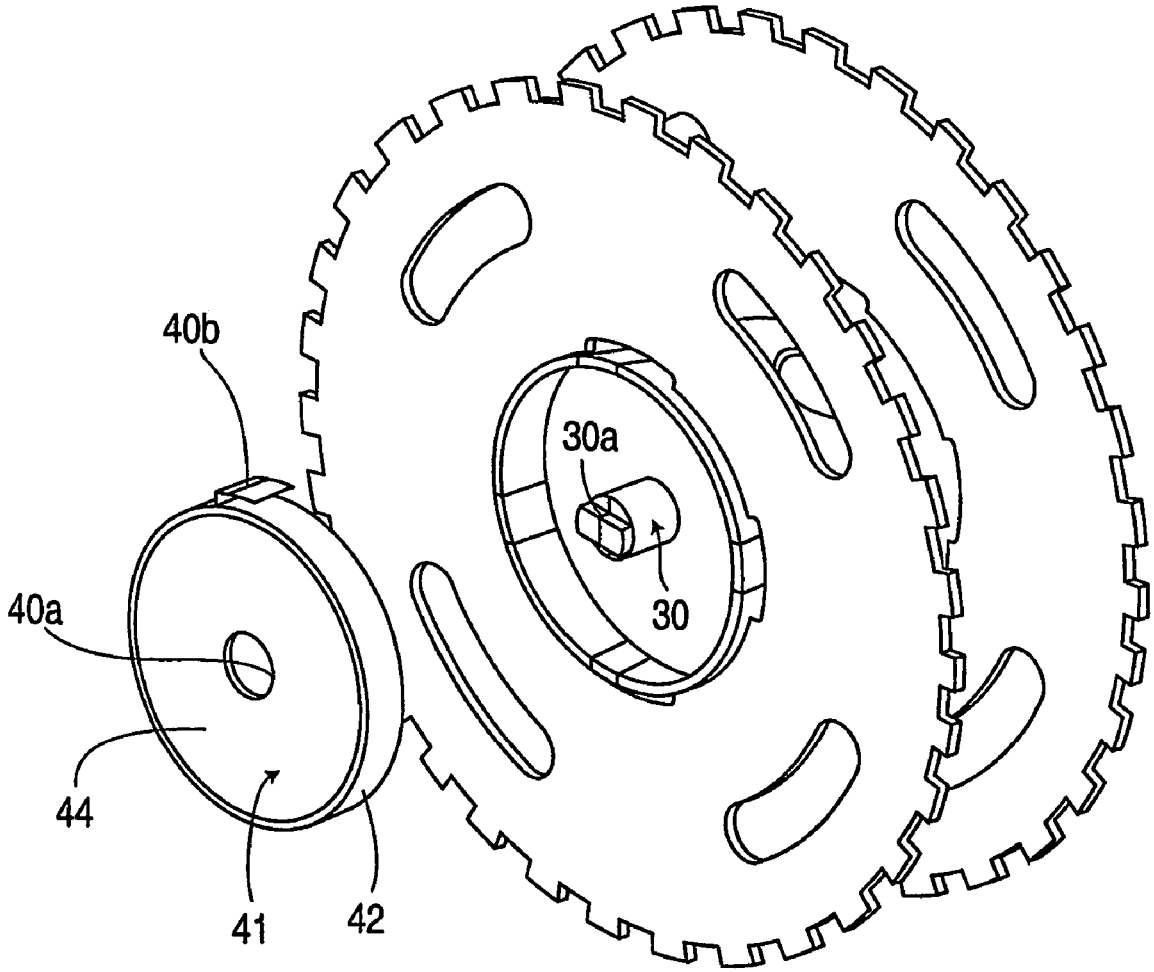
FIG. 6 is an exploded perspective view of the spring and the reel.

The encased spring 40 is thus inserted into the main hub 26 as shown in FIG. 6. It will be appreciated that the main bushing 28 has an axial length less than that of the hub 26, leaving sufficient space for the spring casing 41 to fit fully within the hub 26.

In the preferred embodiment the pin 30 is rotationally fixed relative to the side plates 12, 14 by a square end 30*b*, best seen in FIG. 1, which fits into a square opening in the side plate 12 and thus locks the pin 30 against rotation relative to the housing 10. The reel 20 (and concurrently the main bushing 26 and spring casing 42) rotate around the pin 30.

Figure 3:
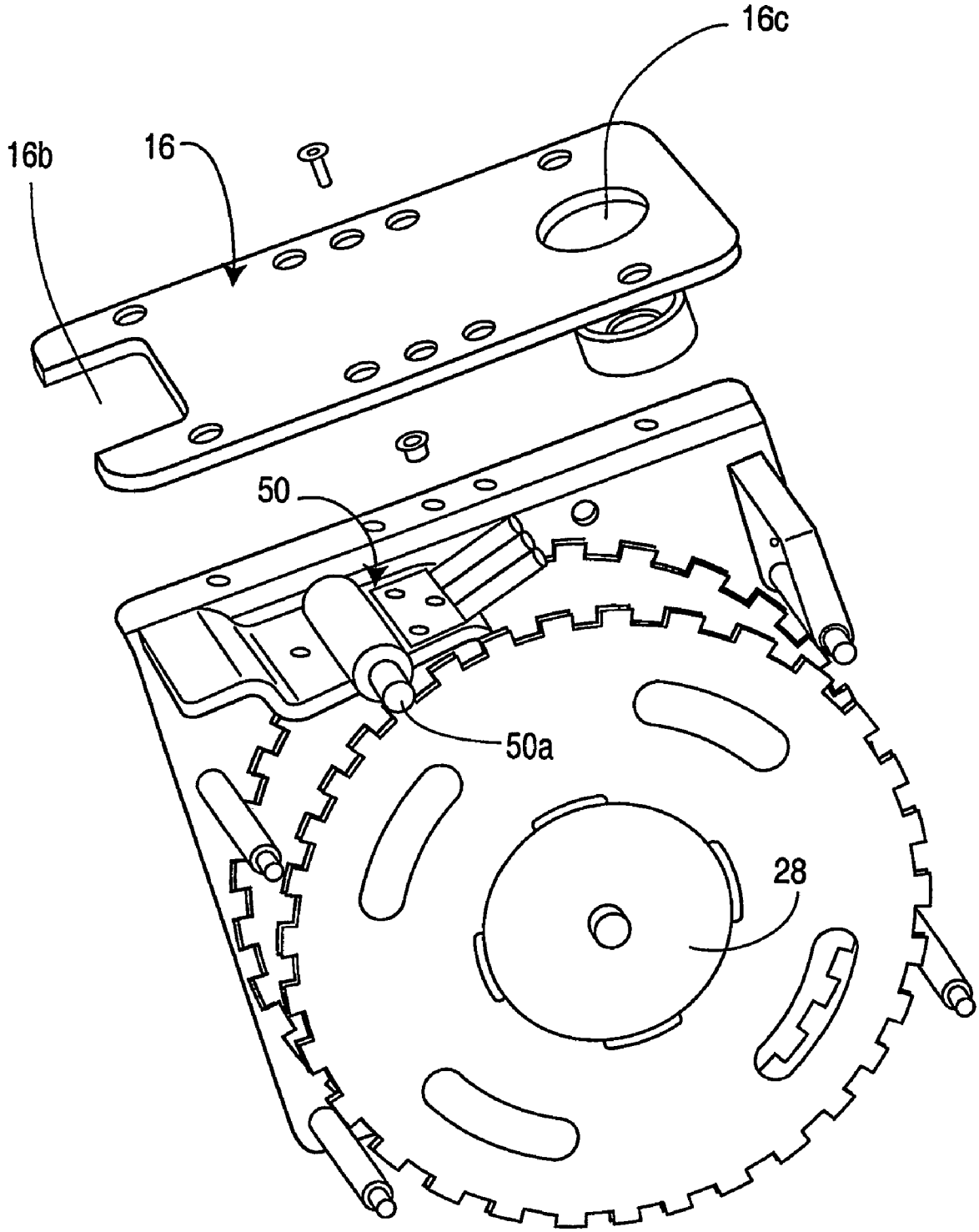
FIG. 3 is a partially exploded view of the device of FIG. 1 with one side plate removed to expose the moving parts of the device.
Figure 7:
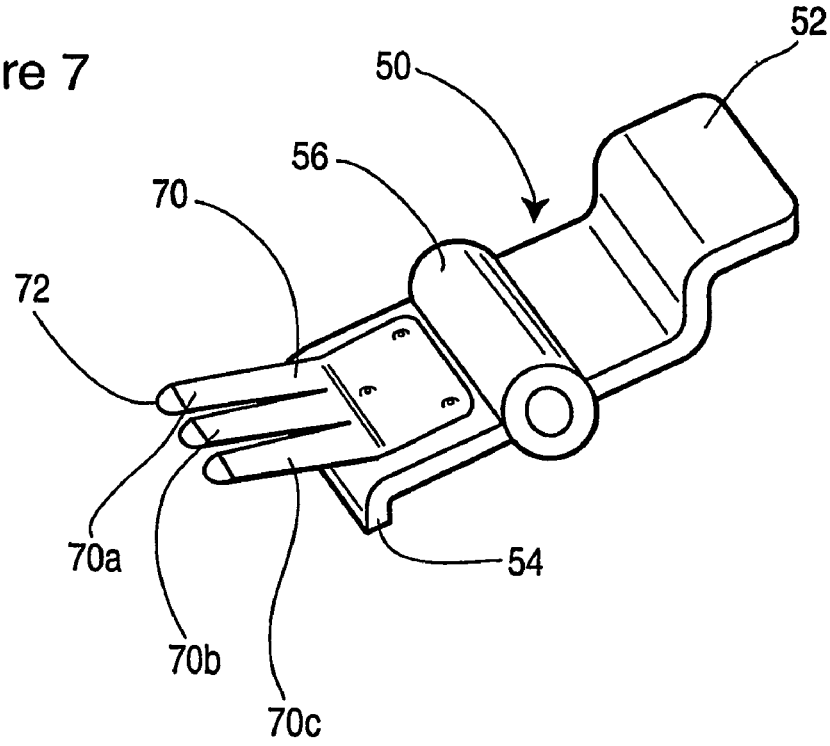
FIG. 7 is a perspective view of the latching member.

In the preferred embodiment the locking mechanism comprises a latching member 50, illustrated in FIG. 7, comprising an actuating plate 52 and a latch 54 disposed on opposite sides of a hub 56. The latching member 50 is engaged to the side plates 12, 14 as by pin 50*a*, seen in FIG. 3, so that as the actuating plate 52 is depressed into the housing 10 the latch 54 moves away from the side walls 22, 24 to unlock the reel 20.

An opening 16*b* is provided in the gunnel plate 16 to expose the latching member 50, preferably approximating the peripheral configuration of the actuating plate 52 for aesthetic reasons and to keep dirt out of the housing 10.

A series of notches 60 is formed in the periphery of each of the side walls 22, 24 of the reel 20. Preferably the notches 60 are provided entirely around the periphery of each sidewall 22, 24, to maximize the number of positions in which the device can lock, separated by sufficient material to withstand the forces normally encountered by the watercraft when moored. The latch 54 is configured to simultaneously engage one of the notches 60 in each of the side walls 22, 24 of the reel 20. The latch 54 thus extends substantially across the entire interior of the housing 10, which both ensures that the latch 54 engages both side walls 22, 24 and allows some deflection of the latching member 50 without dislodging the latch 54 from the notches 60.

Figure 8:
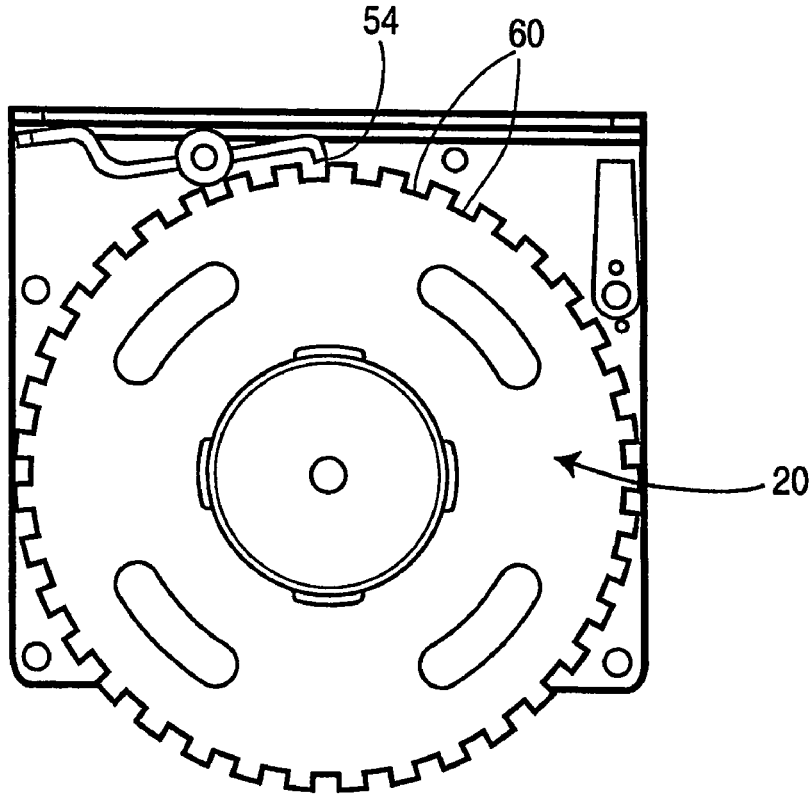
FIG. 8 is a side elevation of the device of FIG. 1 with one side plate removed, showing the device in a fully unlocked position.
Figure 9:
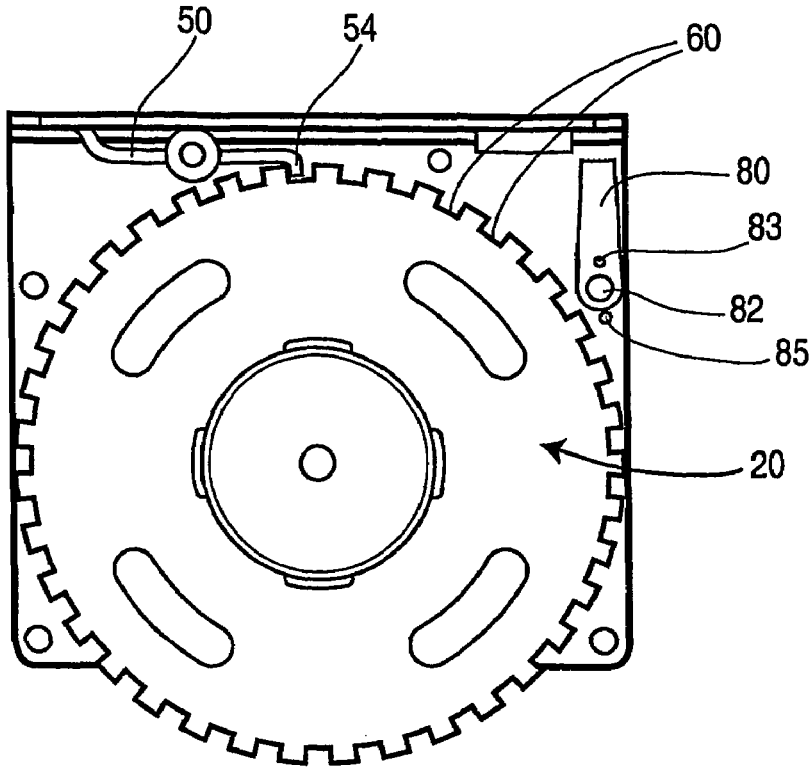
FIG. 9 is a side elevation of the device of FIG. 1 with one side plate removed, showing the device in a locked position.

The latching member 50 is accordingly mounted adjacent to the gunnel plate 16, so as to pivot between the position in which the latch 54 is disengaged from the notches 60 as shown in FIG. 8, which allows the reel 20 to rotate freely, and a position in which the latch 54 is engaged within a notch 60 in each side wall 22, 24, as shown in FIG. 9, to lock the reel 20 against rotation in both directions. In the preferred embodiment the latching member SO is mounted such that the actuating plate 52 is flush with the gunnel plate 16 when the device is in the locked position shown in FIG. 9, and the latch 54 engages each notch 60 in a substantially perpendicular orientation.

Preferably the latching member 50 is spring biased to the locking position, so that the device locks automatically unless the actuating plate 54 is being depressed. In the preferred embodiment this is accomplished by affixing to the latching member 50 as by rivets or any other suitable means, a spring 70, for example a leaf spring. Spring 70 is oriented such that the free end 72 of the spring 70 engages against the underside of the gunnel plate 16. The pressure applied by the spring 70 can be optimized by separating the free end 72 of the spring 70 into a series of fingers 70*a*, 70*b*, 70*c*, the width of each being selected so that the cumulative force supplied by the fingers 70*a*, 70*b*, 70*c* provides the desired resistance to disengagement of the latching member 50. This ensures that the latch 54 does not become dislodged from the notch 60 inadvertently, but at the same time minimizes the pressure required to release the latching member 50.

Figure 10:
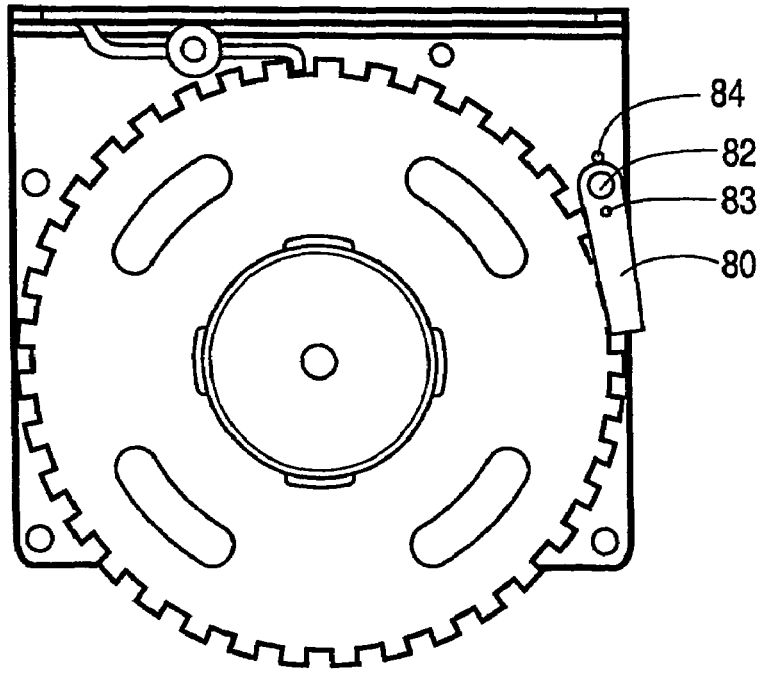
FIG. 10 is a side elevation of the device of FIG. 1 with one side plate removed, showing the device in a locked position with the safety latch engaged.
Figure 11:
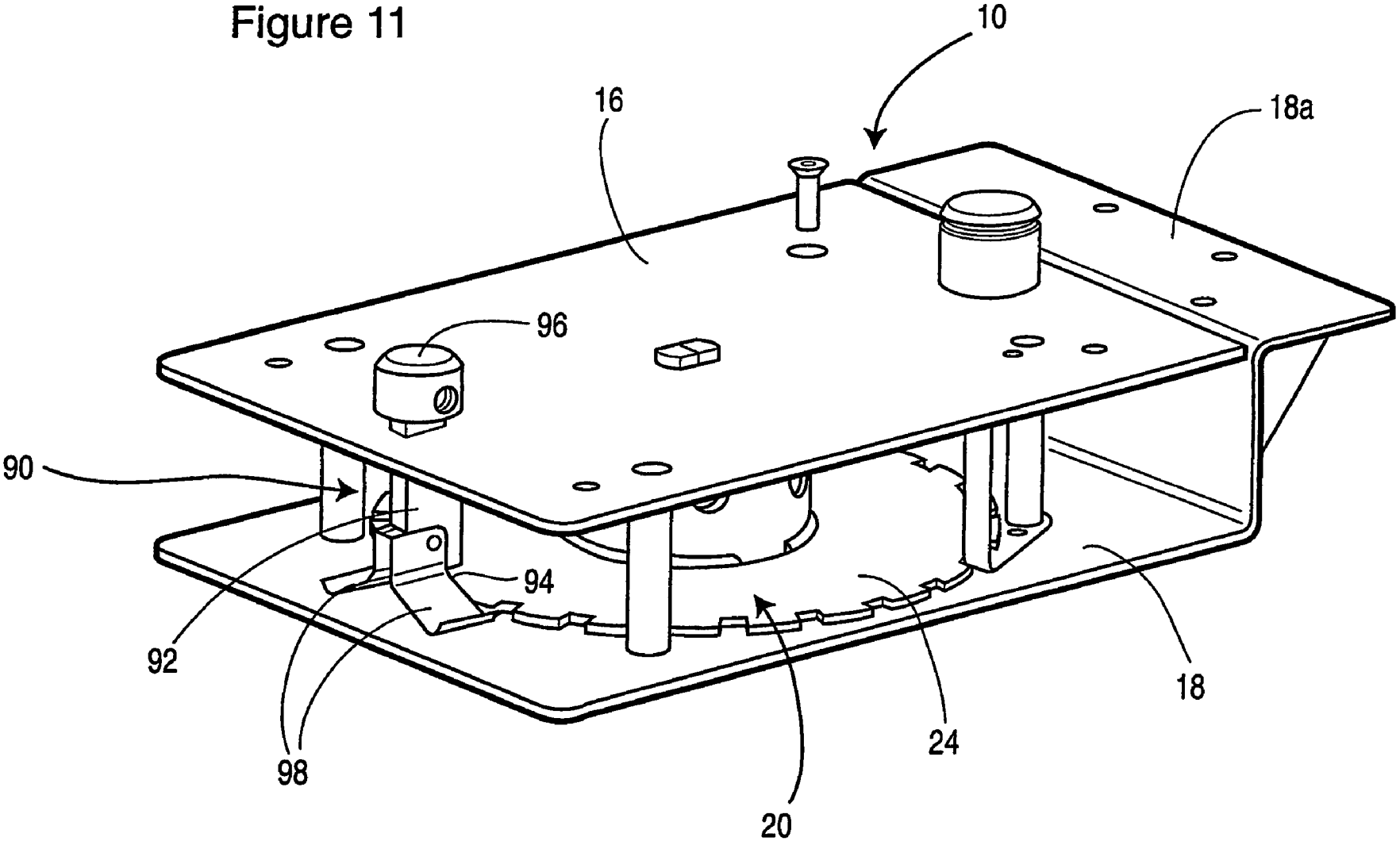
FIG. 11 is a perspective view of a further embodiment of the retractable mooring line device according to the invention, having a generally horizontal orientation.
Figure 12:
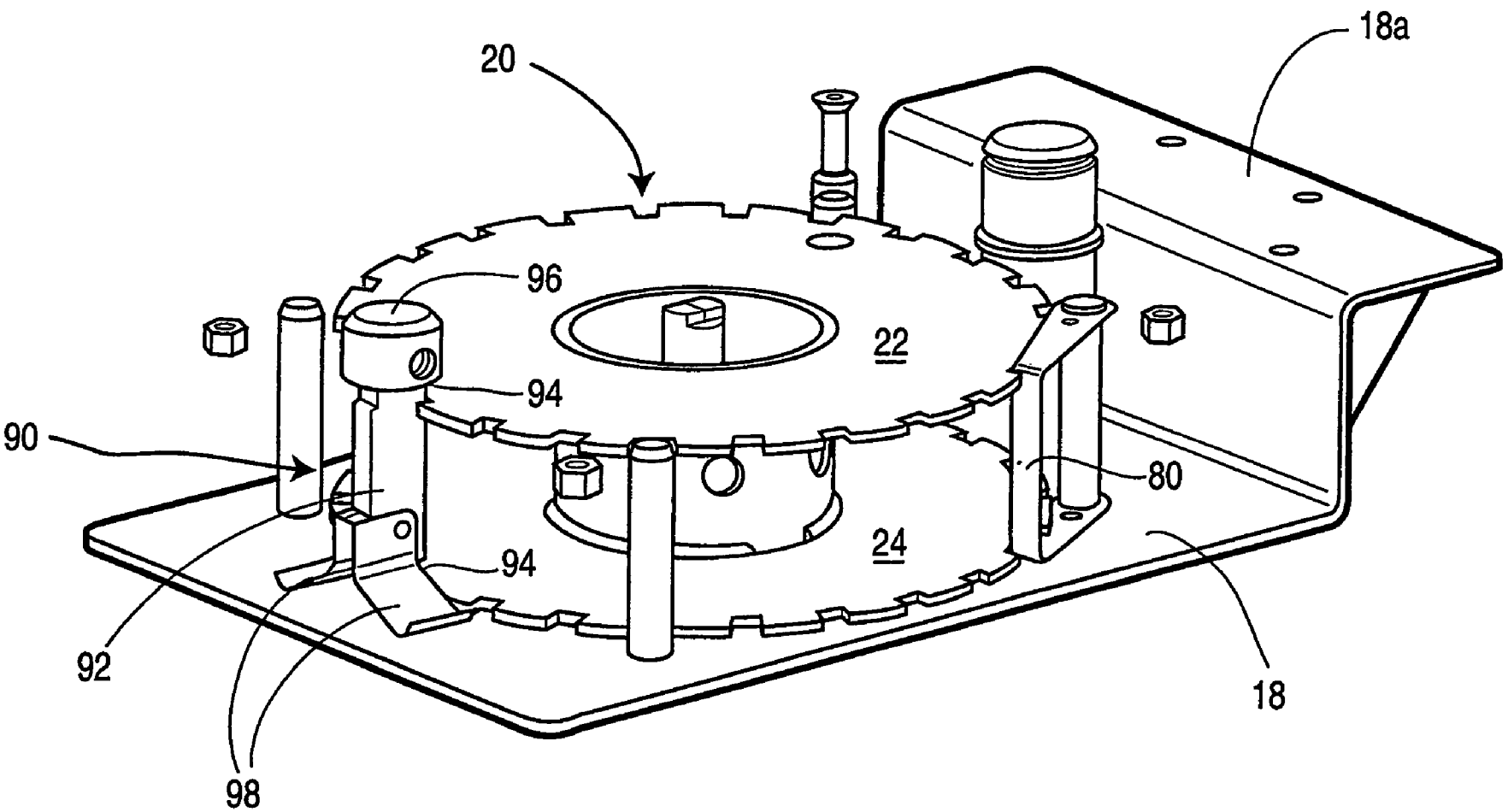
FIG. 12 is a perspective view of the embodiment of FIG. 11 with the top plate removed.
Figure 13:
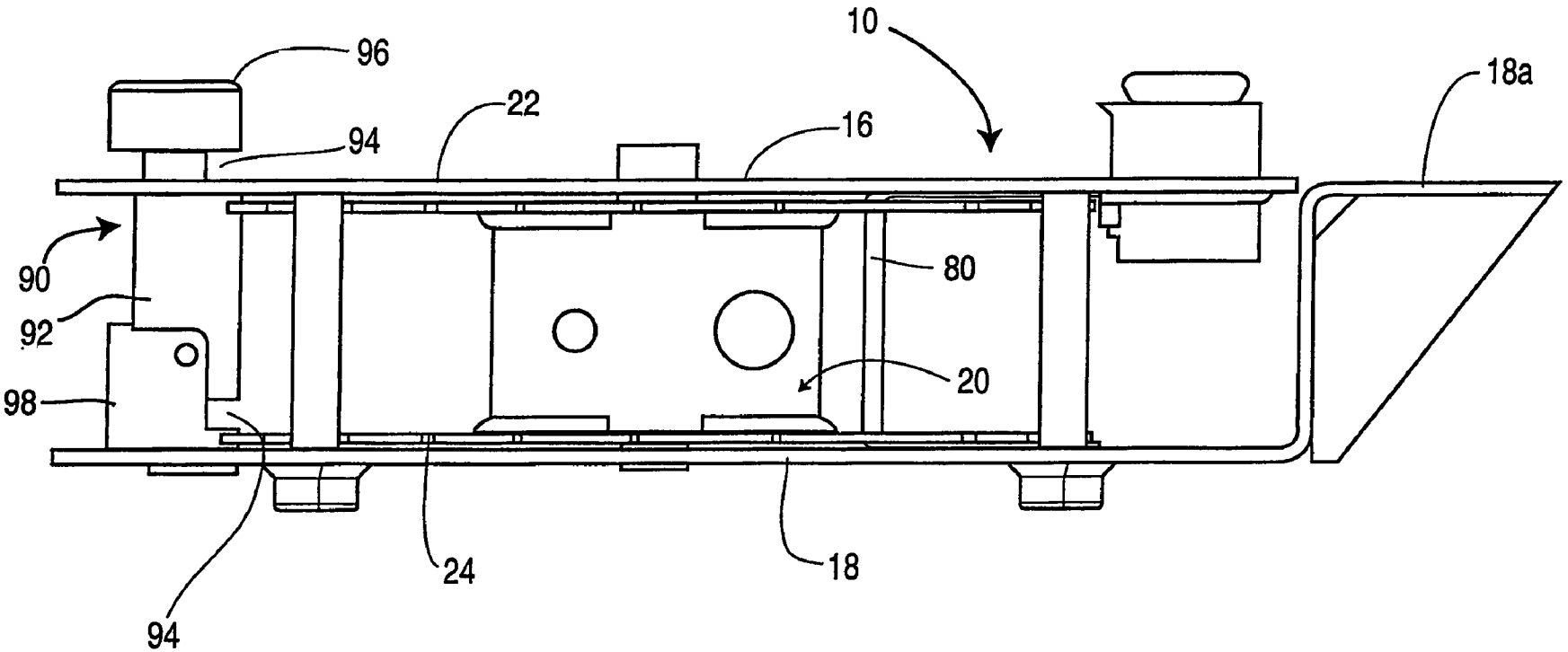
FIG. 13 is a side elevation of the embodiment of FIG. 11, showing the latch in the locked position.

In the preferred embodiment a maintenance lock 80 is also provided, rotatably mounted between the side plates 12, 14 as by a pin 82, in a position adjacent to the reel 20. The maintenance lock 80 can thus be pivoted from the unlocked position, as shown in FIG. 9, to a locked position shown in FIG. 10 in which the reel 20 is prevented from rotating regardless of the position of the latching member 50. During normal operation of the device the maintenance lock 80 is retained in the unlocked position by a boss or stud 84 projecting from the side plate 12 and/or 14 into a hole 83 in the maintenance lock 80. During maintenance or servicing the maintenance lock 80 can be rotated to the locked position and retained in the unlocked position by a boss or stud 85 projecting from the side plate 12 and/or 14 into the hole 83 in the maintenance lock 80. The maintenance lock 80 is provided solely to prevent the reel 20 from uncoiling during servicing or repair activities, and is not used in normal operation.

In use, the gunnel plate 16 is attached to the side plate flanges 12*a*, 14*a* by bolts 16*a*. The reel 20 is rotated a sufficient number of revolutions to retract the mooring line, 2 and the mooring line 2 is passed through the opening 16 and attached to the reel 20. When the reel 20 is released the spring 40 rotates the reel in the take-up direction and the mooring line 2 is automatically loaded onto the hub 26. The device is optionally placed in a water-catching container 8 and mounted into the gunnel 4 of a boat (shown in phantom in FIG. 2), preferably so that the upper surface of the gunnel plate 16 is flush with the gunnel 4, and secured in place as by screws, rivets or other suitable fastening members (not shown) through holes 16*d*.

When the watercraft is to be moored, the actuating plate 52 of the latching member 50 is depressed, which may be conveniently effected by the user's foot. The mooring line 2 is drawn out to the required length and affixed to a dock or other mooring structure (not shown). The spring 40 winds tighter as the mooring line 2 is drawn out, because the end 40*a* engaging the pin 30 remains stationary while the end 40*b* rotates with the hub 26. The actuating plate 52 is released and the latch spring 70 urges the latch 54 into the next nearest notches 60 of the respective sidewalls 22, 24 of the reel 20, thus locking the reel 20 against rotation.

To retract the mooring line 2, the actuating plate 54 is depressed to disengage the latch 54 from the notches 60. The spring 40 rotates the reel 20 in the retracting direction to retract the mooring line 2 back onto the reel 20 for storage.

FIGS. 11 to 15 illustrate a further embodiment of the retractable mooring line device according to the invention. This embodiment has a generally horizontal orientation, which is particularly suitable for mounting on a watercraft via housing flange 10*a*, for example onto the frame between pontoons of a pontoon boat or the like. In this embodiment a latch 90 comprises a latch plate 92 having notches 94 (best seen in FIG. 13) large enough to allow the sidewalls 22, 24 of the reel 20 to pass freely through the notches 94, and spaced apart a distance corresponding to the spacing between the sidewalls 22, 24. The latch 90 is slidably disposed through an opening (not shown) in the top plate 16 at any suitable position adjacent to the reel 20, and movable between a locked position, shown in FIG. 13, with the button 96 raised from the top plate 16 and the notches 94 out of alignment with the reel sidewalls 22, 24; and a release position, shown in FIG. 14, with the button 96 depressed and the notches 94 in alignment with the reel sidewalls 22, 24.

Figure 14:
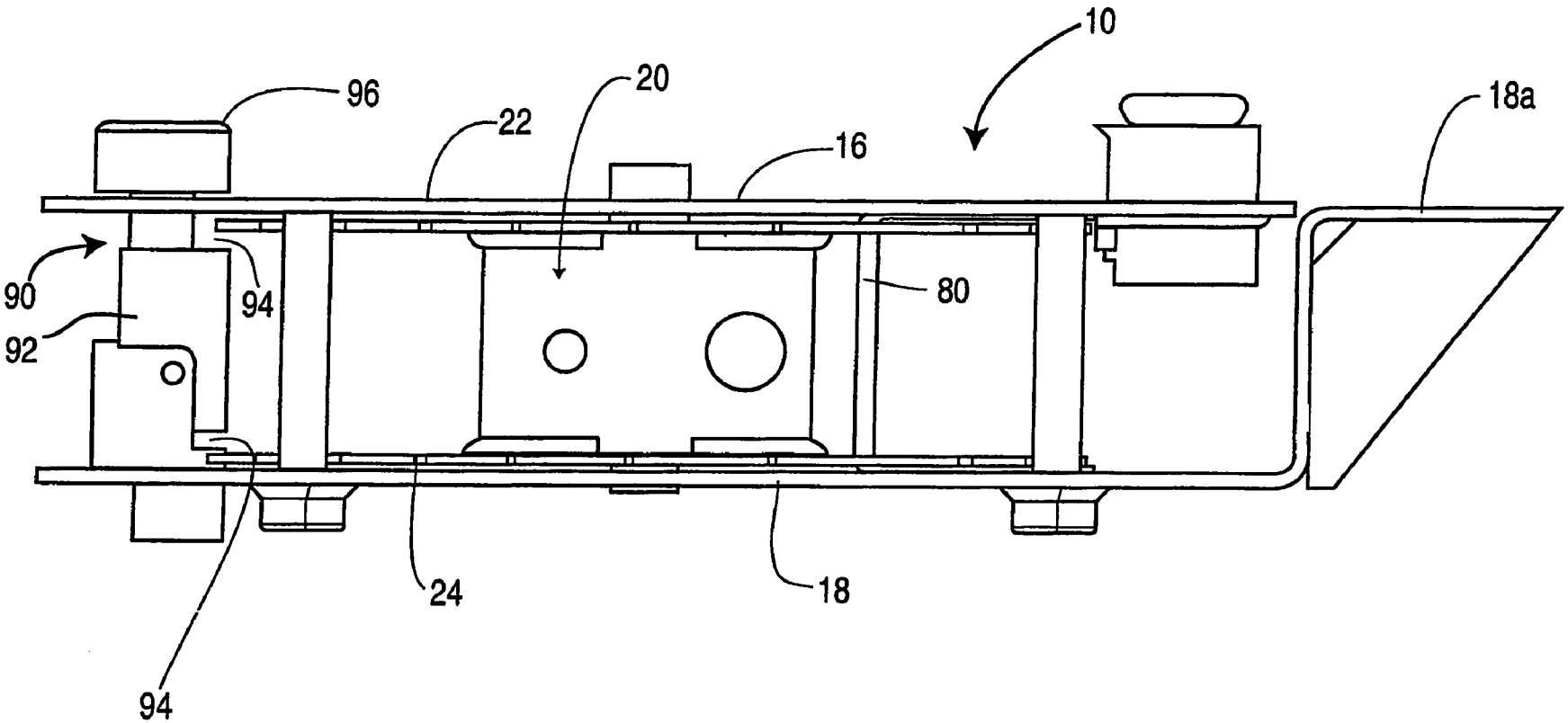
FIG. 14 is a side elevation of the embodiment of FIG. 11, showing the latch in the release position.
Figure 15:
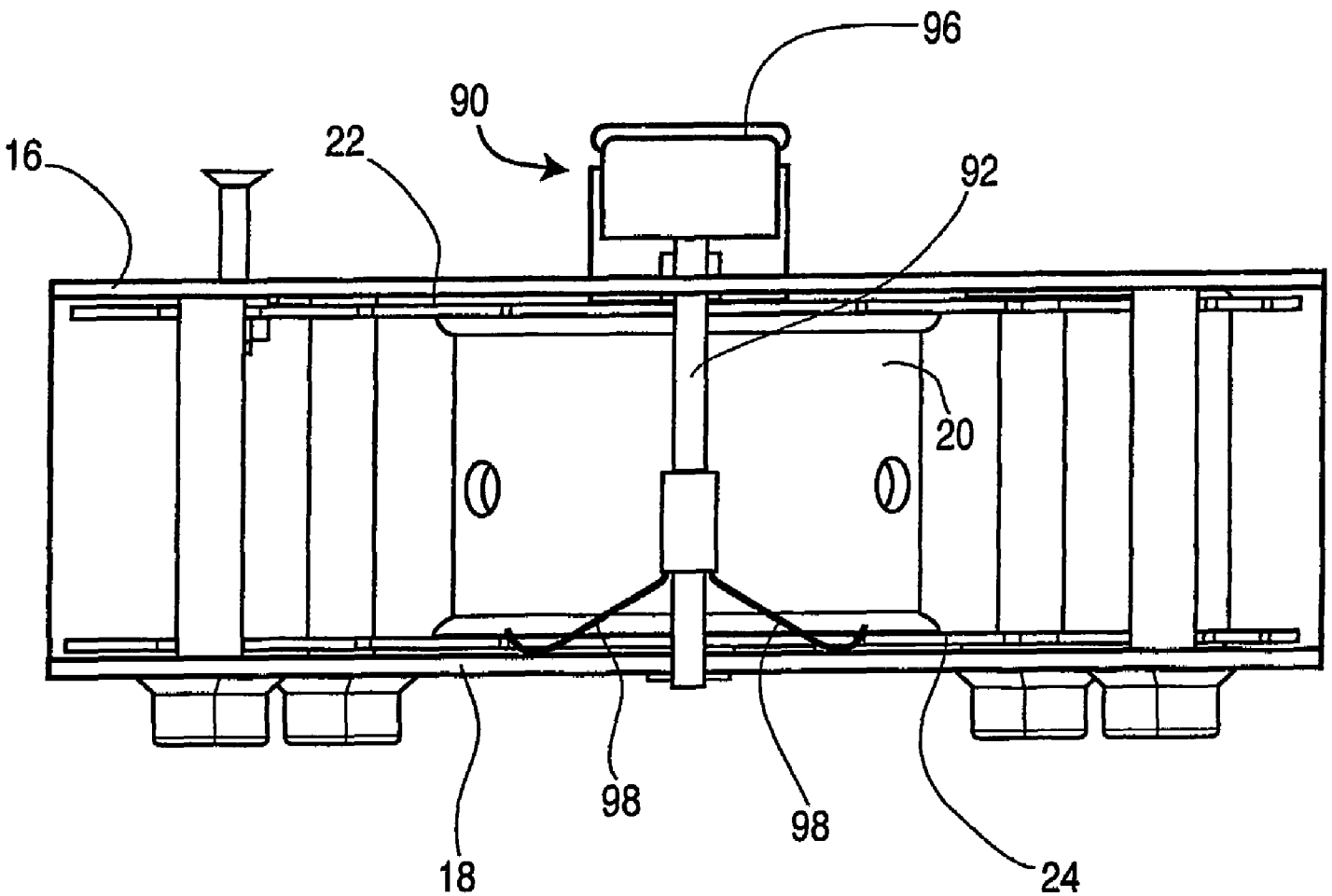
FIG. 15 is an end elevation of the embodiment of FIG. 11.

Preferably the latch 90 is biased to the locked position by one or more springs 98 (two springs 98 are shown in the embodiment illustrated, as best seen in FIG. 15), which bear against the bottom plate 18 of the housing 10. Thus, in this embodiment also the top plate 16 can be removed and reinstalled (after demounting the housing from the frame of the boat) without requiring special loading or positioning of the latch spring 98. As in the previously described embodiment, the button 96 can be actuated by a user's hand or foot. However, in the embodiment of FIGS. 11 to 15 the latch 90 moves axially relative to the reel 20, releasing the reel 20 when the notches 94 are aligned with the reel sidewalls 22, 24, as shown in FIG. 14.

In the operation of the embodiment of FIGS. 11 to 15, the reel 20 is retained in the locked position by engagement of the latch plate 92 with one of the series of notches 60 disposed about the periphery of each sidewall 22, 24. When a user depresses the button 96 the latch plate 92 moves axially relative to the reel 20 until the notches 94 come into alignment with the sidewalls 22, 24, at which point the reel 20 is released and able to rotate in both directions.

In both of the described embodiments, servicing and maintenance of the device 10 is easily effected by removing bolts 16*a* and removing the gunnel plate 16, which exposes the entire interior of the housing 10 and all of the moving components of the device 10.

Various embodiments of the present invention having been thus described in detail by way of example, it will be apparent to those skilled in the art that variations and modifications may be made without departing from the invention. The invention includes all such variations and modifications as fall within the scope of the appended claims.

We claim:

1. A retractable mooring line device, comprising a housing comprising side plates a rotatable reel comprising sidewalls affixed in spaced relation to a hub, rotatably mounted to the side plates of the housing so that the reel is capable of rotating in two directions, the sidewalls each having a series of notches about its periphery, and a locking mechanism comprising a latching member comprising a latch positioned and configured to move axially relative to the reel between an unlocked position in which the latch disengages from the reel and a locked position in which the latch engages at least one of the series of notches about the periphery of each of the side walls of the reel engaging both side walls to prevent rotation of the reel in both of the two directions, the latching member comprising a latch plate having notches spaced apart a distance corresponding to a spacing between the sidewalls and large enough to allow the sidewalls to pass freely therethrough, whereby when the latch is engaged to the notches of both side walls the reel is prevented from rotation in both of the two directions, and when the latch is disengaged from the notches of both side walls the reel is capable of rotation in both of the two directions.

2. The device of claim 1 wherein the latching member comprises a spring bearing against the housing and urging the latch toward the locked position.

3. The device of claim 1 wherein the latching member comprises an actuating plate exposed to an exterior of the housing.

4. The device of claim 3 wherein the latching member is biased to the locked position by a spring bearing against the housing.

5. The device of claim 1 wherein the latch plate is slidably disposed through the housing adjacent to the reel and exposed to an exterior of the housing for actuation.

6. The device of claim 5 wherein the latching member is biased to the locked position by a spring bearing against the housing.

7. The device of claim 6 wherein the latch plate is slidably disposed through a gunnel plate and the spring bears against a bottom plate of the housing.

8. The device of claim 1 wherein the reel comprises a hub mounted over a bushing comprising a self-lubricating plastic, which is rotatably mounted to a pin projecting from the housing.

9. The device of claim 8 wherein the reel is spring loaded for automatic retraction when the locking mechanism is released.

10. The device of claim 9 wherein a spring has a first anchoring end engaging the pin and a second anchoring end engaging the hub.

11. The device of claim 10 wherein the spring is contained within a casing which contains the spring against dislodgement when the reel is removed from the housing.

12. The device of claim 8 wherein the pin is rotationally fixed relative to the housing and the reel rotates around the pin.

13. A retractable mooring line device, comprising a housing comprising side plates and a gunnel plate affixed to a top edge of each side plate, a rotatable reel comprising sidewalls affixed in spaced relation to a hub, rotatably mounted to the side plates of the housing so that the reel is capable of rotating in two directions, the sidewalls each having a series of notches about its periphery, and a locking mechanism comprising a latching member comprising an actuating plate exposed to an exterior of the housing and a latch disposed on opposed sides of the hub, the latch being positioned and configured to move between an unlocked position in which the latch disengages from the reel and a locked position in which the latch engages at least one of the series of notches about the periphery of each of the side walls of the reel to prevent rotation of the reel in both of the two directions, the latching member comprising a latch plate having notches spaced apart a distance corresponding to a spacing between the sidewalls and large enough to allow the sidewalls to pass freely therethrough.

whereby when the latch is engaged to the notches of both side walls the reel is prevented from rotation in both of the two directions, and when the latch is disengaged from the notches of both side walls the reel is capable of rotation in both of the two directions.

14. The device of claim 13 wherein the latch plate is slidably disposed through the housing adjacent to the reel and exposed to an exterior of the housing for actuation.

15. The device of claim 14 wherein the latch plate is slidably disposed through a gunnel plate and the spring bears against a bottom plate of the housing.

* * * * *